US009581353B2

(12) United States Patent
Kurniawan et al.

(10) Patent No.: US 9,581,353 B2
(45) Date of Patent: Feb. 28, 2017

(54) HVAC SYSTEM INCLUDING A NOISE-REDUCING FEATURE

(75) Inventors: Darius Kurniawan, Clarkston, MI (US); Norbert Bikos, Rochester, MI (US)

(73) Assignee: Valeo Climate Control Corporation, Auburn Hills, MI (US)

( * ) Notice: Subject to any disclaimer, the term of this patent is extended or adjusted under 35 U.S.C. 154(b) by 1609 days.

(21) Appl. No.: 12/359,278

(22) Filed: Jan. 23, 2009

(65) Prior Publication Data

US 2010/0190431 A1 Jul. 29, 2010

(51) Int. Cl.
*F24F 7/007* (2006.01)
*F24F 13/24* (2006.01)
*F24F 13/14* (2006.01)

(52) U.S. Cl.
CPC ..... *F24F 13/24* (2013.01); *F24F 13/14* (2013.01); *F24F 13/1406* (2013.01); *F24F 2221/46* (2013.01)

(58) Field of Classification Search
CPC ..... F24F 7/007
USPC ..... 454/262
See application file for complete search history.

(56) References Cited

U.S. PATENT DOCUMENTS 3,605,797 A * 9/1971 Dieckmann et al. ..... 137/375
3,839,950 A * 10/1974 Kelly et al. ..... 454/145
4,031,862 A * 6/1977 Smith ..... 122/421
4,100,938 A * 7/1978 Dravnieks et al. ..... 137/625.31
4,196,849 A * 4/1980 Dehart et al. ..... 236/49.4
4,316,522 A * 2/1982 Hirschorn ..... 181/224
4,726,563 A * 2/1988 Inglis ..... 251/127
4,953,655 A * 9/1990 Furukawa ..... 181/160
5,154,893 A * 10/1992 Nakade ..... 422/124
5,260,523 A * 11/1993 Pettersson et al. ..... 181/224
5,679,073 A 10/1997 Hsieh et al.
5,723,828 A * 3/1998 Nakagawa ..... 181/250
5,836,813 A 11/1998 Miyata et al.
5,964,658 A 10/1999 Aizawa et al.
6,132,666 A * 10/2000 Foley et al. ..... 264/313
6,139,423 A * 10/2000 Wadey ..... 454/142
(Continued)

FOREIGN PATENT DOCUMENTS

WO WO2008019519 A1 * 2/2008 ..... F24F 13/14

*Primary Examiner* — Steven B McAllister
*Assistant Examiner* — Samantha Miller
(74) *Attorney, Agent, or Firm* — Dierker & Kavanaugh, P.C.

(57) ABSTRACT

A HVAC system includes a housing including at least one wall, an air flow path defined at least partially by the at least one wall, and a door disposed in the air flow path, where the door is configured to i) block a flow of air through the air flow path when the door is in at least one closed position, and ii) allow the flow of air through the air flow path when the door is in a position other than the at least one closed position. A gap is formed between the door and the at least one wall when the door is in the position other than the at least one closed position. The HVAC system further includes a noise-reducing feature defined on at least a portion of the at least one wall. The noise-reducing feature configured to break up, into several smaller structures, an air flow structure formed when air flowing through the gap contacts an end of the door, thereby reducing air vibration in the gap and reducing noise of the HVAC system during operation thereof.

15 Claims, 4 Drawing Sheets

(56) References Cited

U.S. PATENT DOCUMENTS

| | | | | |
|---|---|---|---|---|
| 6,200,215 | B1 * | 3/2001 | Larsson et al. | 454/187 |
| 6,752,240 | B1 * | 6/2004 | Schlagenhaft | 181/249 |
| 6,811,744 | B2 * | 11/2004 | Keicher et al. | 419/5 |
| 6,920,959 | B2 * | 7/2005 | Han et al. | 181/224 |
| 7,090,575 | B2 | 8/2006 | Ito et al. | |
| 7,472,774 | B1 * | 1/2009 | Monson et al. | 181/256 |
| 2003/0025586 | A1 * | 2/2003 | Parry et al. | 337/273 |
| 2004/0048027 | A1 * | 3/2004 | Hayes et al. | 428/53 |
| 2004/0148969 | A1 * | 8/2004 | Nikander | 65/114 |
| 2006/0060341 | A1 | 3/2006 | Maehata | |
| 2007/0123159 | A1 | 5/2007 | Venkatappa et al. | |
| 2007/0204927 | A1 * | 9/2007 | Yamashita et al. | 138/26 |
| 2008/0108293 | A1 | 5/2008 | Haupt et al. | |
| 2008/0223652 | A1 * | 9/2008 | Dyck et al. | 181/224 |
| 2008/0242210 | A1 * | 10/2008 | Viertel et al. | 454/76 |
| 2009/0133957 | A1 * | 5/2009 | Owens | 181/224 |
| 2009/0189018 | A1 * | 7/2009 | Dittmar et al. | 244/121 |
| 2009/0318072 | A1 * | 12/2009 | Perera | 454/194 |
| 2010/0029189 | A1 * | 2/2010 | Wood | 454/76 |
| 2010/0105312 | A1 * | 4/2010 | Bamberger | F24F 13/14 454/266 |
| 2012/0285665 | A1 * | 11/2012 | Rebeyrotte et al. | 165/104.34 |
| 2013/0171924 | A1 * | 7/2013 | Rider et al. | 454/366 |

* cited by examiner

HVAC SYSTEM INCLUDING A NOISE-REDUCING FEATURE

BACKGROUND

The present disclosure relates generally to HVAC systems and, more particularly, to an HVAC system including a noise-reducing feature.

HVAC systems are often used for climate control of, e.g., internal cabin areas of an automobile. HVAC systems are typically configured with an HVAC unit having at least one heat exchanger disposed in a housing and, in some instances, an HVAC distribution system operatively connected to the HVAC unit. The HVAC system further includes one or more air flow paths for allowing air to flow, for example, to, from, and/or within the HVAC unit and the HVAC distribution system. Additionally, the HVAC system includes one or more doors operatively associated with the air flow path for controlling the amount of air flowing to, through, and/or from the HVAC unit and/or the HVAC distribution system. In instances where one of the doors is in a partially open position, substantially laminar high speed flow of the air travels through a gap formed in the air flow path between the door and the housing wall. In some instances, this high speed laminar air flow generates undesirable noises (e.g., whistles or hisses) in the HVAC.

SUMMARY

An HVAC system including a noise-reducing feature is disclosed herein. The HVAC system includes a housing including at least one wall, an air flow path defined at least partially by the wall(s), and a door disposed in the air flow path, where the door is configured to i) block a flow of air through the air flow path when the door is in at least one closed position, and ii) allow the flow of air through the air flow path when the door is in a position other than the at least one closed position. A gap is formed between the door and the wall(s) when the door is in the position other than the at least one closed position. The HVAC system further includes a noise-reducing feature configured to break up, into several smaller structures, an air flow structure formed when air flowing through the gap contacts an edge of the door, thereby reducing air vibration in the gap and reducing noise of the HVAC during operation thereof.

BRIEF DESCRIPTION OF THE DRAWINGS

Features and advantages of embodiments of the present disclosure will become apparent by reference to the following detailed description and drawings, in which like reference numerals correspond to the same or similar, though perhaps not identical, components. For the sake of brevity, reference numerals or features having a previously described function may or may not be described in connection with other drawings in which they appear.

DETAILED DESCRIPTION

Embodiment(s) of the HVAC system, as disclosed herein, include a noise-reducing feature configured to reduce audible noise generated by air flow through a gap defined in an air flow path between a door and a housing wall of the HVAC system. The noise-reducing feature advantageously reduces audible noise (such as, e.g., a whistle, a hiss, or the like) by as much as, for example, 10 decibels (dB). The noise-reducing feature is not only advantageously easy to incorporate into the HVAC system, but also does not substantially interfere with normal operations of the HVAC system, including, for example, functionalities of the door or other internal HVAC parts.

Figure 1A:
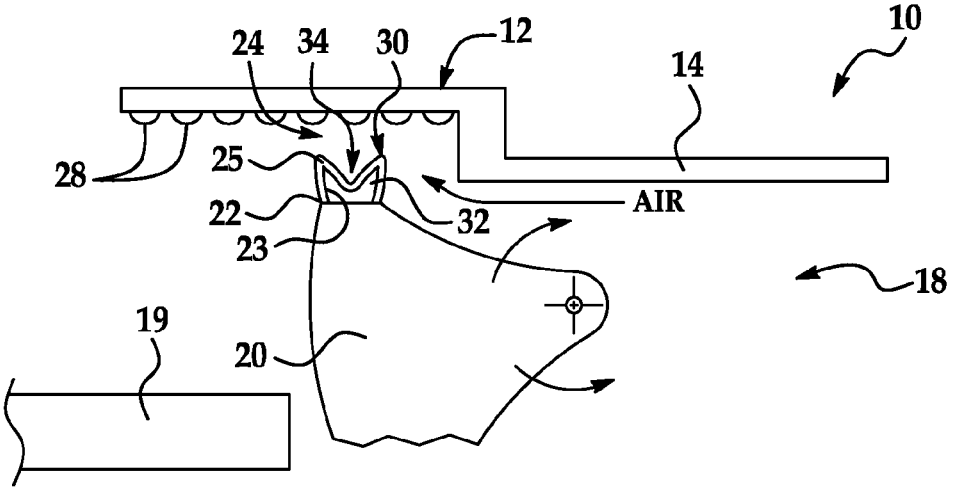
FIGS. 1A and 1B schematically depict examples of a portion of an HVAC system.
Figure 1B:
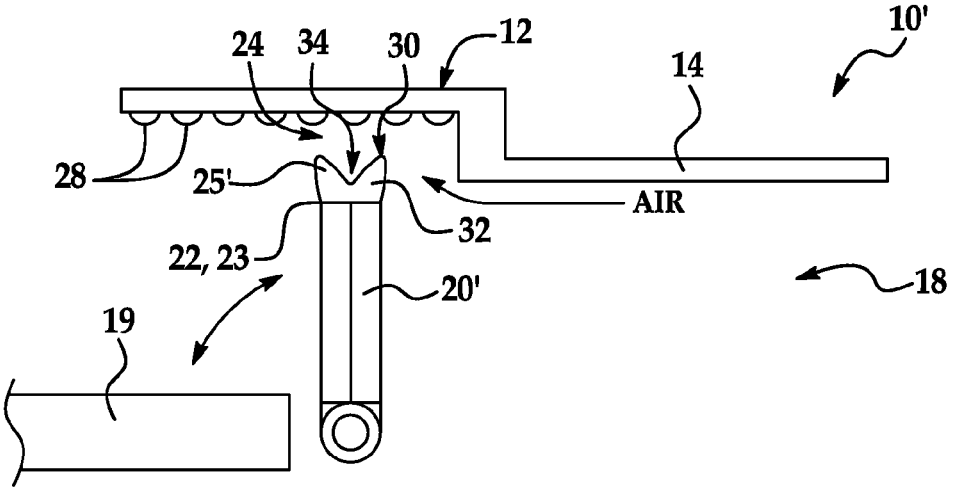

Referring now to the drawings, FIGS. 1A and 1B schematically depict examples of a portion of an HVAC system 10, 10'. As used herein, an "HVAC system" refers to an HVAC unit, an HVAC distribution system, or a combination of both. The HVAC system may be used in, for example, a motor vehicle (not shown in the figures). The HVAC system 10, 10' generally includes a housing 12 including at least one wall 14. In instances where the HVAC is an HVAC unit, at least one heat exchanger (not shown) is disposed in the housing 12 and is in operative fluid communication with an air flow path 18 defined at least partially by the wall 14. In instances where the HVAC system is an HVAC distribution system, the air flow path 18, having a primary air stream flowing therethrough, is defined at least partially by the wall 14 of the housing 12 and is in operative fluid communication with one or more air outlets, air inlets, distribution paths or ducts, and/or one or more vehicle operating systems. The air flow path 18 may also be divided in two or more paths using one or more dividers 19 (one divider 19 shown in FIGS. 1A and 1B). In an example, the divider 19 may divide the air flow path 18 into right and left air streams for providing air to right and left sides of, e.g., an internal vehicle cabin.

The HVAC system 10, 10' further includes a door 20, 20' disposed in the air flow path 18. The door 20, 20' could be any door used in the HVAC system 10, 10', non-limiting examples of which include an air inlet door, a blend door, an air distribution door, air direction doors (such as, e.g., a door that directs air to the internal cabin of the motor vehicle or a door that directs air to defrosting/defogging systems), or the like, or combinations thereof. The door 20, 20' is generally configured to block a flow of air through the air flow path 18 when the door 20, 20' is in at least one closed position. For example, in instances where the door 20, 20' is an air inlet door, the door 20, 20' may have a single closed position; namely to prevent air from flowing into the HVAC system 10. In instances where the door 20, 20' is an air distribution door, the door 20, 20' may have more than one closed position. For example, the door 20, 20' may be designed to close more than one air flow path (e.g., to distribute air between a defrost system, a ventilation system, and a passenger compartment of a vehicle). As used herein, the term "closed position" refers to a position of a door disposed in the air flow path 18 when an end 22 of the door 20, 20' abuts the housing wall 14, thereby substantially restricting or even eliminating flow of air through the air flow path 18. The door 20, 20' is further configured to allow the flow of air through the air flow path 18 when the door 20, 20' is in a position other than the closed position. As used herein, the term "a position other than the closed position"

refers to a position of the door 20, 20' when the end 22 of the door 20, 20' does not abut the housing wall 14, thereby allowing flow of air through the air flow path 18. It is to be understood that "the position other than the closed position" includes any position of the door 20, 20' when air is allowed to flow through the air flow path 18, non-limiting examples of which include a completely open position and a partially open position. It is further to be understood that when the door 20, 20' is in the partially open position, the door 20 may be, for example, 99% open, 0.1% open, or any position therebetween.

It is to be understood that the door 20, 20' may have a number of different shapes including, but not limited to, a curved shape, a flat shape, a barrel shape, or the like. FIG. 1A shows an example of the door 20 including a barrel shape. FIG. 1B shows another example of the door 20', having a flat shape.

Figure 4A:
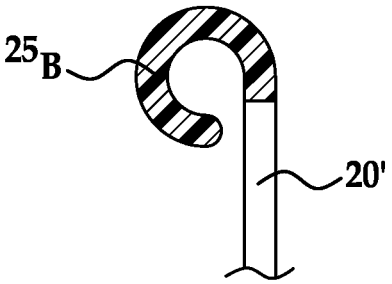
FIGS. 4A through 4H schematically depict different examples of a shape of a door seal or edge.
Figure 4B:
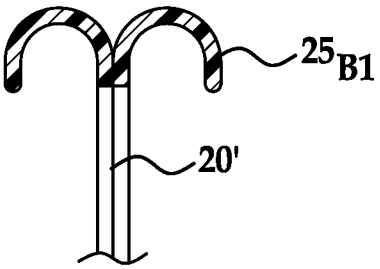
Figure 4C:
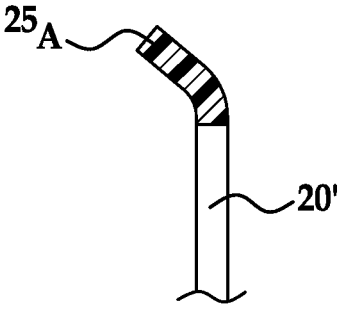
Figure 4D:
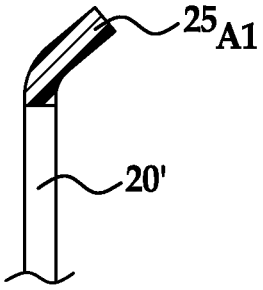
Figure 4E:
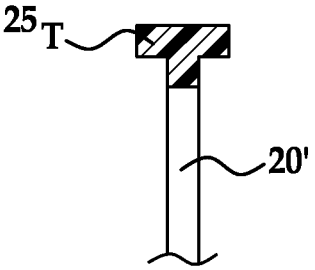
Figure 4F:
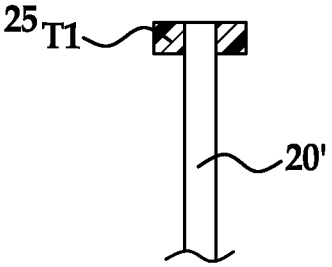
Figure 4G:
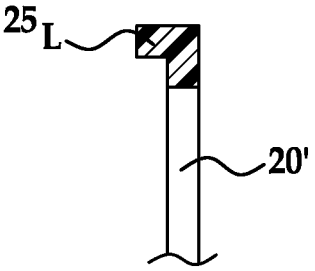
Figure 4H:
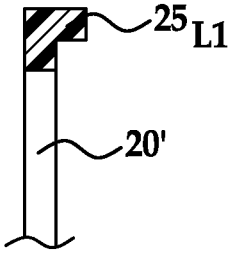

It is further to be understood that the end 22 of the door 20, 20' includes a door rim and a door seal. In the example shown in FIG. 1A, the door 20 includes a door rim 23 having a predetermined shape with a seal 25 overlying the rim 23 and conforming thereto. In the example shown in FIG. 1B, the door 20 includes a door rim (not shown) and a door seal 25' having a predetermined shape disposed over the door rim. As such, the door rim 23 and/or the door seal 25 may include any shape having at least a portion of which forms an edge 30. In the examples depicted in FIGS. 1A and 1B, the door rim 23 and the door seal 25 are v-shaped, respectively. It is to be understood that other examples of the shape of the door rim 23 and the door seal 25 not depicted in the drawings may otherwise be used. Several examples of the door seal are shown in the FIG. 4 series. Although the FIG. 4 series are shown as door seals, it is to be understood that the various shapes shown may also be implemented as the door edges themselves. FIGS. 4A and 4B show the door seal $\mathbf{25}_B$ and $\mathbf{25}_{B1}$ as bulb shaped. Further, FIGS. 4C and 4D show the door seal $\mathbf{25}_A$ and $\mathbf{25}_{A1}$ as angular. Additionally, FIGS. 4E and 4F show the door seal $\mathbf{25}_T$ and $\mathbf{25}_{T1}$ as T-shaped. Also, FIGS. 4G and 4H show the door seal $\mathbf{25}_L$ and $\mathbf{25}_{L1}$ as L-shaped.

Again with reference to FIG. 1, a gap 24 is formed between the wall 14 and the door seal 25, 25' when the door 20, 20' is in the position other than the closed position. When the door 20, 20' is in this position, air is allowed to flow through the gap 24. This air flow is a secondary air flow stream in fluid communication with the air flow path 18. It is to be understood that the secondary air flow stream is part of the primary air flow stream flowing through the air flow path 18. In an embodiment, the flow of the air through the gap 24 may be a substantially laminar flow at a speed up to about 35 m/s; and the reference air speed may range from about 2 m/s to about 10 m/s.

Laminar flow of the air flowing through the gap 24 may be due, at least in part, on a percentage of closure of the door 20, 20', the speed of the air traveling through the air flow path 18, a smoothness of the housing wall 14, and a lack of extreme bends, curves, or other distortions in the air flow path 18. Other factors that may also affect the laminar flow through the gap 24 include, for example, the viscosity of the air and the density of the air.

It is to be understood that the substantially laminar high speed flow of the air through the gap 24 may induce the aforementioned undesirable whistle or other audible noise when the HVAC is operating. More specifically, the air flows, at the high speed, through the gap 24 and contacts the edge of the door seal 25, 25'. In the examples shown in FIGS. 1A and 1B, the air (which flows from right to left in the figures) contacts the edge 30 of the door seal 25, 25' at an upstream side of the gap 24 and develops an air flow structure. Non-limiting examples of air flow structures include laminar air flow, air flow vortex/vortices, air flow shear, and/or the like. In an embodiment, the developed air flow structure is an air flow vortex. The air flow structure vibrates surrounding air particles and generates undesirable sound waves (i.e., noise) in and/or near the gap 24. It is to be understood that in instances where the shape of the door seal is such that it has more than one lip and a cavity (identified by reference numeral 34 in FIGS. 1A and 1B) formed between each lip 32 (such as, e.g., a v-shape as shown in FIGS. 1A and 1B), the air flow structure may be reinforced by perpendicular air pulsation in the cavity, thereby increasing the amplitude of the undesirable sound waves created by the air flow structure in the gap 24.

Without being bound to any theory, it is believed that the noise generated from the substantially laminar high speed flow of the air traveling through the gap 24 (and contacting the door rim 23 or the door seal 25) may be reduced by breaking up the air flow structure into several smaller structures. For example, if the air flow structure is an air flow vortex, the laminar high speed flow may be reduced by breaking up the vortex into several smaller vortices. When this occurs, air vibration in the gap 24 is substantially reduced, thereby reducing the noise in the HVAC system. It is to be understood that the several smaller structures (formed by breaking up the air flow structure) induce turbulent flow of the air flowing through the gap 24. Still with reference to FIGS. 1A and 1B, the turbulent flow may be induced by defining a noise-reducing feature 28 on at least a portion of the wall 14, at least a portion of which is generally located in the gap 24.

Figure 2:
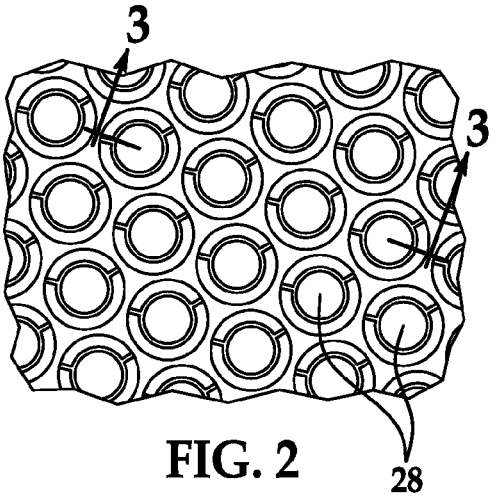
FIG. 2 schematically depicts a plan view of a housing wall of the portion of the HVAC system of FIG. 1 including an example of a noise-reducing feature.
Figure 3:
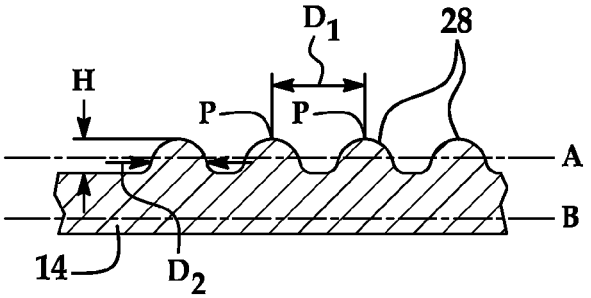
FIG. 3 schematically depicts a cross-sectional view of the noise-reducing feature taken along line 3-3 in FIG. 2.

In an embodiment, the noise-reducing feature 28 includes a plurality of protrusions defined on at least a portion of the housing wall 14. As shown in FIGS. 2 and 3, the protrusions 28 may, for example, have a substantially circular cross-section in a plane A, which is substantially parallel to a plane B containing the housing wall 14 (planes A and B are shown in FIG. 3 going into and coming out of the page). It is to be understood, however, that the protrusions 28 may include other cross-sectional shapes, non-limiting examples of which include an oval cross-section, an elliptical cross-section, a rectangular cross-section, a square cross-section, a diamond cross-section, or the like. It is further to be understood that the rectangular, square, or diamond cross-sections may be used so long as the corners of the shape are rounded. Without being bound to any theory, it is believed that sharp (non-rounded) corners of the rectangular, square, or diamond cross-sections break smooth flow of the air in between the protrusions 28, thereby possibly inducing an undesirable air flow structure between adjacent protrusions 28 arranged on the housing wall 14 (described in further detail below). The air flow structure may also generate undesirable noise.

In a non-limiting example, the plurality of protrusions 28 is substantially uniformly arranged on housing wall 14. For example, as shown in FIGS. 2 and 3, the protrusions 28 are formed in a uniform arrangement, e.g., in rows having a predetermined distance $D_1$ from a center point P of one protrusion 28 to that of an adjacent protrusion 28. In another non-limiting example, the plurality of protrusions 28 is randomly arranged on the housing wall 14.

Regardless of the arrangement of the protrusions 28, all of the protrusions 28 may be substantially uniform in size, in one non-limiting example. In a further non-limiting example, if the protrusions 28 have a circular cross-section, each protrusion 28 has a diameter $D_2$ ranging from about 1 mm to about 3 mm, and each as a height H ranging from about 0.5 mm to about 2 mm. It is to be understood that the shape, height, and/or diameter of the protrusions 28 may be adjusted in order to achieve i) the desired reduction in noise, and ii) a permissible amount of air flow through the gap 24. It is further to be understood that the shape, height, and/or diameter of the protrusions 28 is also adjustable with respect to an available space defined in the HVAC system 10 for defining the protrusions 28 on the wall 14.

In an example, the protrusions 28 are formed on the wall 14 above the door 20, 20' (as shown in FIGS. 1A and 1B). It is to be understood, however, that the protrusions 28 may be formed i) below the door 20, 20', or ii) above and below the door 20, 20'.

Figure 5A:
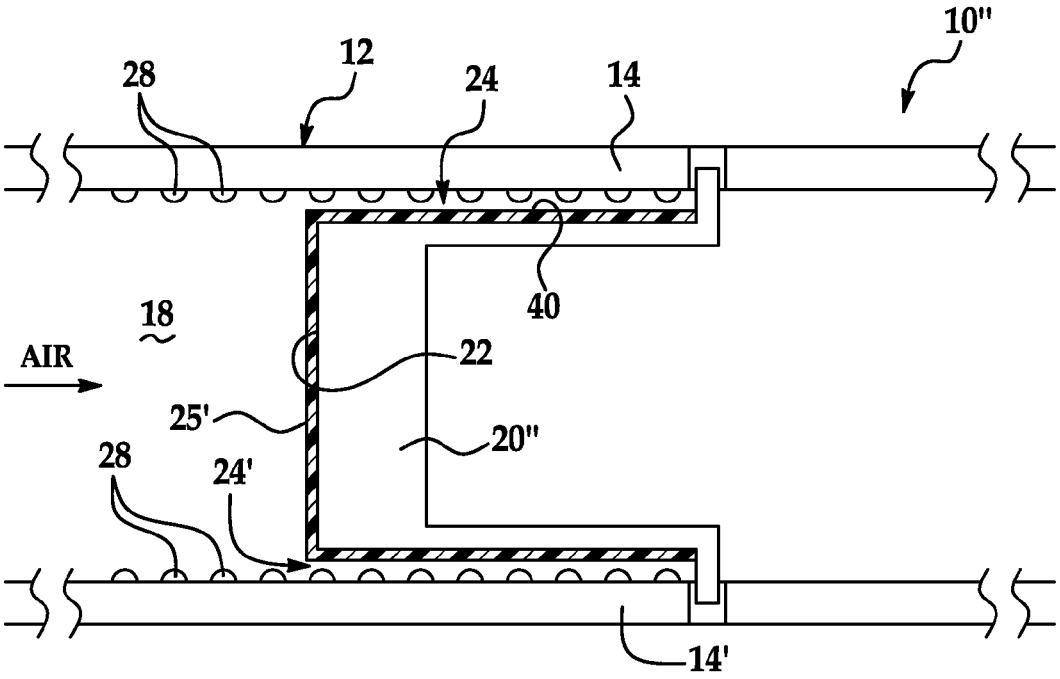
FIGS. 5A and 5B schematically depict another example of a portion of an HVAC system.
Figure 5B:
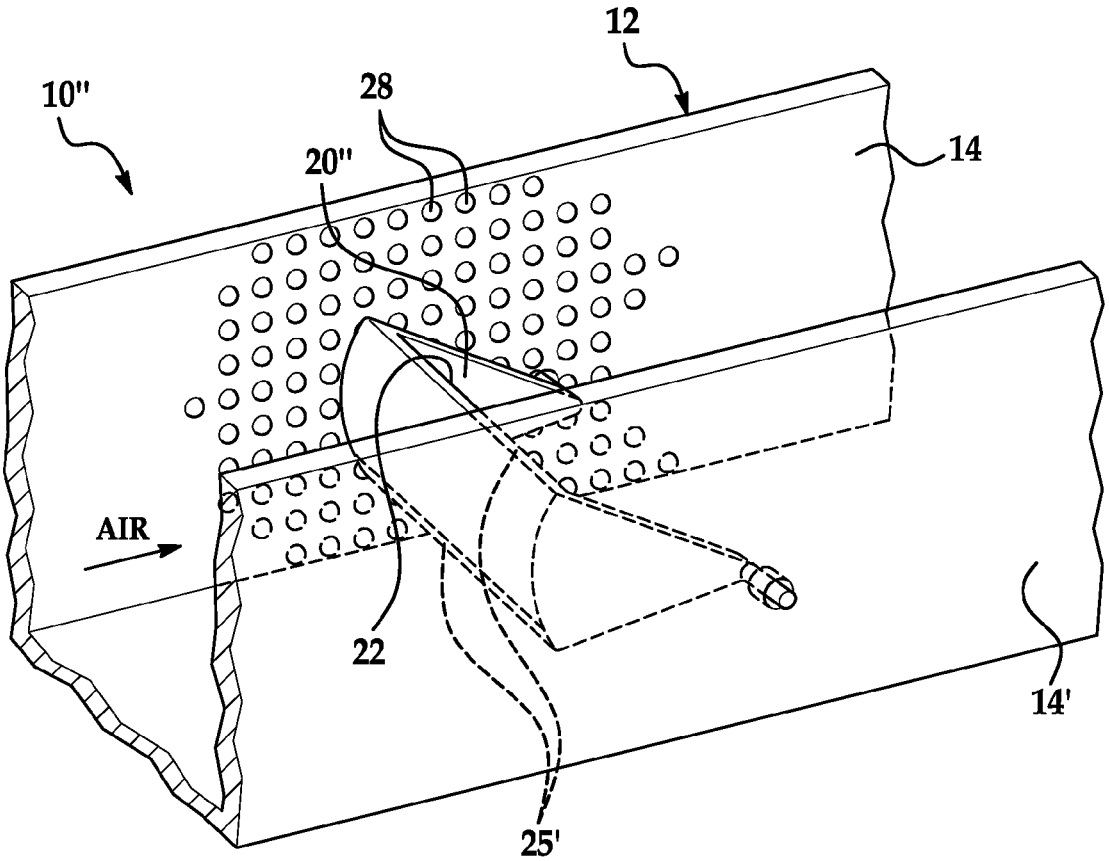

It is further to be understood that the protrusions may otherwise be formed on at least a portion of the wall 14 located near a side of the door. For example, another embodiment of the HVAC system 10" is depicted in FIGS. 5A and 5B. In this example, the door 20" is a barrel-shaped door disposed between two walls 14, 14', where the door 20" includes the door seal 25' at the end 22 thereof. The gap 24 is formed between the wall 14 and the door seal 25', and another gap 24' is formed between the wall 14' and the door seal 25' when the door 20" is in the position other than the closed position. In the foregoing example, the protrusions 28 are formed on a portion of the wall 14, 14' located near a side 40 of the door 20".

In an embodiment, the protrusions 28 are formed integrally with the wall 14, 14'. This may be accomplished by defining a pattern of the protrusions 28 in a mold used for forming the housing wall 14, 14'. More specifically, material used for the mold is removed at predetermined areas defining the pattern of the protrusions 28. Thereafter, the wall 14, 14' is formed including the protrusions 28 by injecting a material (e.g., a plastic or other suitable material for the housing wall 14) into the mold.

In another embodiment, the protrusions 28 are formed in a separate component via any suitable forming process such as, e.g., injection molding. The separate component is thereafter attached to the housing wall 14, 14' via a suitable attachment means. In a non-limiting example, the attachment means is an adhesive. In another non-limiting example, the attachment means is a welding material established by, for example, hot plate welding, ultrasonic welding, heat staking, or the like. In yet another non-limiting example, the attachment means may be a mechanical attachment such as, for example, an interlock, a snap-fit, a fastener, or the like.

In yet another embodiment, the protrusions 28 are defined on the wall 14, 14' via a machining process after the wall 14, 14' is formed. Non-limiting examples of suitable machining processes include milling, laser machining, or the like.

Also disclosed herein is a method for reducing noise in the HVAC system 10. Using the embodiments of the HVAC system 10 described above, the method includes introducing air into the air flow path 18 and inducing turbulent flow of the air when the air contacts the noise-reducing feature 28.

Figure 6A:
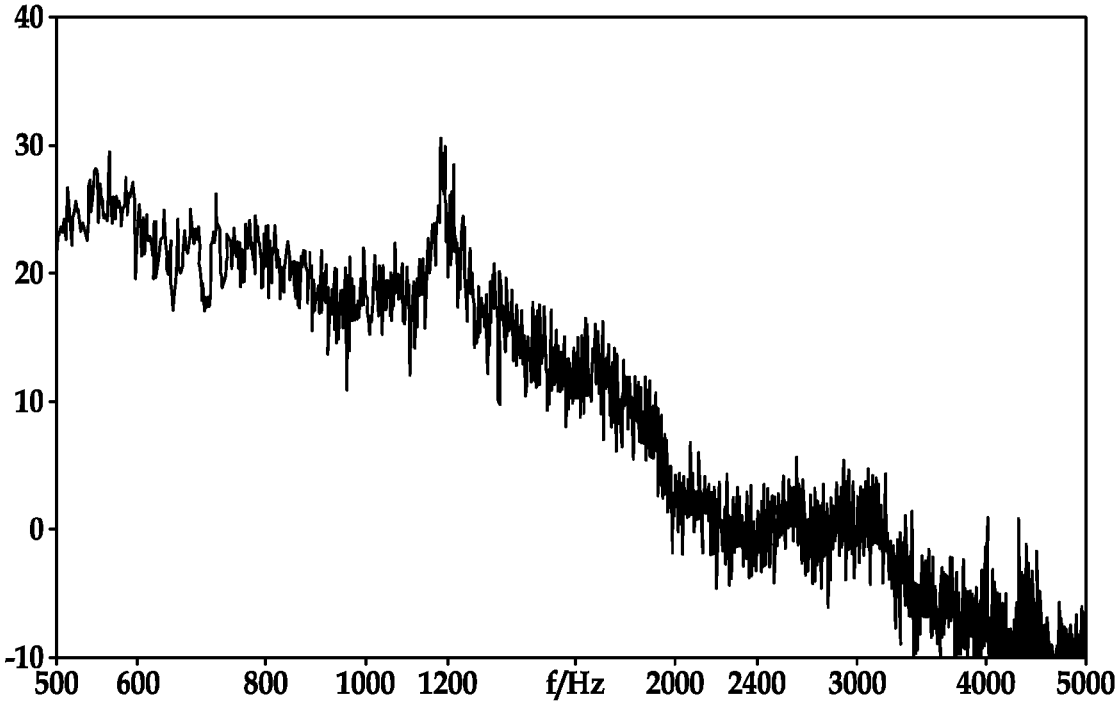
FIGS. 6A and 6B are sound profiles for an HVAC system without a noise-reducing feature and an HVAC system including a noise-reducing feature, respectively.
Figure 6B:
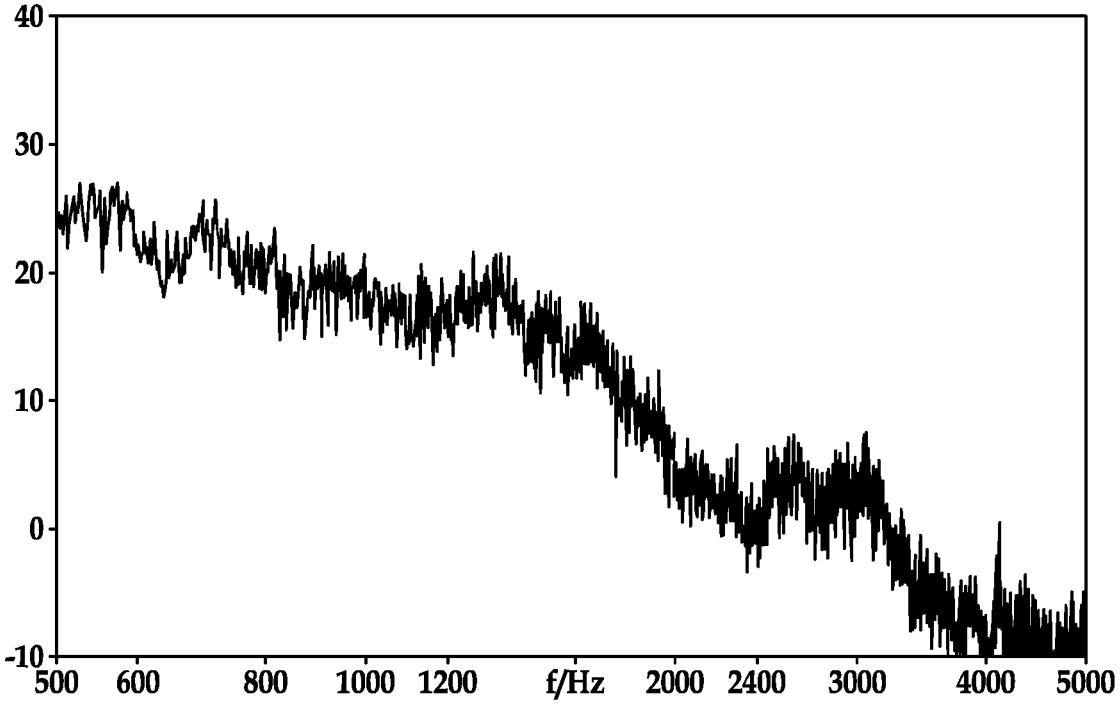

To reiterate from above, the induced turbulent flow reduces the noise of the HVAC system 10. For example, FIGS. 6A and 6B depict sound profiles for an HVAC system without a noise-reducing feature (as shown in FIG. 6A) and an HVAC system including the noise-reducing feature 28 (as shown in FIG. 6B) for a door opened about 25%. The x-axis for each of these sound profiles identifies the sound frequency (Hz) of the noise generated from the air flowing through the gap 24 (shown in FIG. 1). The y-axis identifies the sound pressure level in decibels (reference pressure 20 μPa).

In the sound profile for the HVAC system without a noise-reducing feature (i.e., FIG. 6A), the noise generated from the air flow in the gap 24 shows a measured decibel level of about 35 dB at about 1200 Hz. The sound profile for the HVAC including the noise-reducing feature (i.e., FIG. 6B), however, shows reduced amounts of noise (about 10 dB) at about 1200 Hz, indicating a reduction in noise.

It is to be understood that the terms "above," "below," "near a side," or the like are not intended to be limited to, nor necessarily meant to convey a spatial orientation, but rather are used for illustrative purposes to differentiate between different locations of the protrusions 28 relative to the door 20, 20', 20" in any spatial orientation (top, bottom, side, angularly offset, and/or the like).

While several embodiments have been described in detail, it will be apparent to those skilled in the art that the disclosed embodiments may be modified and/or other embodiments may be possible. Therefore, the foregoing description is to be considered exemplary rather than limiting.

What is claimed is:

1. An HVAC system, comprising:

a housing including at least one wall;

an air flow path defined at least partially by the at least one wall;

a door disposed in the air flow path, the door configured to i) block a flow of air through the air flow path when the door is in at least one closed position; and ii) allow the flow of air through the air flow path when the door is in a position other than the at least one closed position;

a gap formed between the door and the at least one wall when the door is in the position other than the at least one closed position; and a plurality of protrusions fixedly defined on at least a portion of the at least one wall to reduce noise, wherein:

each protrusion in the plurality of protrusions has a substantially circular cross-section, in a plane substantially parallel to a plane containing the at least one wall;

each protrusion in the plurality of protrusions extends from about 0.5 mm to about 2 mm into the air flow path; and the plurality of protrusions breaks up laminar high speed air, when flowing through the air flow path, into turbulent air flowing through the gap, thereby reducing air vibration in the gap and reducing noise of the HVAC system during operation thereof.

2. The HVAC system as defined in claim 1 wherein the plurality of protrusions is substantially uniformly arranged on the at least a portion of the at least one wall.

3. The HVAC system as defined in claim 1 wherein the plurality of protrusions is randomly arranged on the at least a portion of the at least one wall.

4. The HVAC system as defined in claim 1 wherein each of the plurality of protrusions has a diameter ranging from about 1 mm to about 3 mm.

5. The HVAC system as defined in claim 1 wherein the door is an air inlet door, an air blend door, an air distribution door, air direction doors, or combinations thereof.

6. The HVAC system as defined in claim 1 wherein the end of the door includes at least one of a door rim or a door seal, and wherein the at least one of the door rim or the door seal is v-shaped, L-shaped, T-shaped, angular, bulb-shaped, or combinations thereof.

7. The HVAC system as defined in claim 1 wherein the at least one of the door rim or the door seal includes at least one edge, the at least one edge configured to generate the air flow structure when the air flowing through the gap contacts the at least one edge.

8. The HVAC system as defined in claim 1 wherein the door is curve shaped, flat shaped, barrel shaped, or combinations thereof.

9. A method of reducing noise in a HVAC system, the method comprising:

providing the HVAC system, including:

a housing including at least one wall;

an air flow path defined at least partially by the at least one wall;

a door disposed in the air flow path, the door configured to i) block a flow of air through the air flow path when the door is in at least one closed position and ii) allow the flow of air through the air flow path when the door is in a position other than the at least one closed position;

a gap formed between the door and the at least one wall when the door is in the position other than the at least one closed position; and a plurality of protrusions fixedly defined on at least a portion of the at least one wall, wherein: each protrusion in the plurality of protrusions has a substantially circular cross-section, in a plane substantially parallel to a plane containing the at least one wall; and each protrusion in the plurality of protrusions extends from about 0.5 mm to about 2 mm into the air flow path;

introducing air into the air flow path; and breaking up laminar high speed air flowing in the air flow path into turbulent air flowing through the gap by operation of the plurality of protrusions on the air in the air flow path, thereby reducing air vibration in the gap and reducing noise of the HVAC system.

10. The method as defined in claim 9 wherein the noise is caused by an air flow vortex, and wherein the method further comprises breaking up the air flow vortex into several smaller vortices.

11. The method as defined in claim 10 wherein the breaking up of the air flow vortex into several smaller vortices induces turbulent flow of the air through the gap.

12. A method of making an HVAC system, comprising:

providing a housing including at least one wall;

defining an air flow path at least partially by the at least one wall;

disposing a door in the air flow path, the door configured to i) block a flow of air through the air flow path when the door is in at least one closed position and ii) allow the flow of air through the air flow path when the door is in a position other than the at least one closed position, wherein when the door is in the position other than the at least one closed position, a gap is formed between the door at the at least one wall; and fixedly defining a plurality of protrusions on at least a portion of the at least one wall, wherein:

each protrusion in the plurality of protrusions has a substantially circular cross-section, in a plane substantially parallel to a plane containing the at least one wall;

each protrusion in the plurality of protrusions extends from about 0.5 mm to about 2 mm into the air flow path; and the plurality of protrusions breaks up laminar high speed air, when flowing through the air flow path, into turbulent air flowing through the gap, thereby reducing air vibration in the gap and reducing noise of the HVAC system during operation thereof.

13. The method as defined in claim 12 wherein the step of defining of the plurality of protrusions is a step of integrally molding the plurality of protrusions on at least a portion of the at least one wall.

14. The method as defined in claim 12 wherein the defining of the plurality of protrusions is accomplished by:

forming the plurality of protrusions in a separate component; and attaching the component to the at least one wall.

15. The method as defined in claim 12 wherein the defining of the plurality of protrusions is accomplished by machining the plurality of protrusions into the at least one wall.

* * * * *